US010513368B2

(12) United States Patent
Iwahara et al.

(10) Patent No.: US 10,513,368 B2
(45) Date of Patent: Dec. 24, 2019

(54) PACKAGING BODY

(71) Applicants: Dai Iwahara, Kanagawa (JP); Tomonori Nosaka, Tokyo (JP)

(72) Inventors: Dai Iwahara, Kanagawa (JP); Tomonori Nosaka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 10 days.

(21) Appl. No.: 15/955,627

(22) Filed: Apr. 17, 2018

(65) Prior Publication Data

US 2018/0305067 A1 Oct. 25, 2018

(30) Foreign Application Priority Data

Apr. 19, 2017 (JP) ..... 2017-082712

(51) Int. Cl.
*B65D 5/46* (2006.01)
*B65D 19/44* (2006.01)
(Continued)

(52) U.S. Cl.
CPC ..... *B65D 5/46168* (2013.01); *B65D 19/20* (2013.01); *B65D 19/44* (2013.01);
(Continued)

(58) Field of Classification Search
CPC ... B65D 5/10; B65D 5/12; B65D 5/46; B65D 5/46168; B65D 5/468; B65D 5/72; B65D 19/00; B65D 19/06; B65D 19/20; B65D 19/44; B65D 21/02; B65D 71/02; B65D 77/26; B65D 81/05; B65D 81/056; B65D 81/113; B65D 85/64; B65D 85/68; B65D 2519/00029; B65D 2519/00064;
(Continued)

(56) References Cited

U.S. PATENT DOCUMENTS 2,790,544 A * 4/1957 Whiton ..... B65D 5/326 206/320
3,194,474 A * 7/1965 Rumberger ..... B65D 5/0227 206/459.5
(Continued)

FOREIGN PATENT DOCUMENTS

FR 1528831 A * 6/1968 ..... B65D 5/5092
JP 58-183462 10/1983
(Continued)

*Primary Examiner* — Bryon P Gehman
(74) *Attorney, Agent, or Firm* — Duft & Bornsen, PC

(57) ABSTRACT

A packaging body includes a base on which a packaging target is placed, a box including first flaps and second flaps, and a binding body configured to bind the base and the box and disposed between the first flaps and the second flaps. The box has a rectangular shape and an upper opening portion and configured to cover a top face and side faces of the packaging target. The first flaps are disposed in pairs opposing to each other extending from opposite scorelines of the upper opening portion and including an opening through which an included object is inserted. The second flaps are disposed in pairs opposing to each other extending from different opposite scorelines of the upper opening portion and configured to be folded over the first flaps when the first flaps are folded. The first flaps further include partial flap portions.

20 Claims, 5 Drawing Sheets

(51) Int. Cl.

| | |
|---|---|
| ***B65D 19/20*** | (2006.01) |
| ***B65D 21/02*** | (2006.01) |
| ***B65D 85/64*** | (2006.01) |
| ***B65D 85/68*** | (2006.01) |

(52) U.S. Cl.
CPC ..... *B65D 21/02* (2013.01); *B65D 85/64* (2013.01); *B65D 85/68* (2013.01); *B65D 2519/00293* (2013.01); *B65D 2585/649* (2013.01); *B65D 2585/6892* (2013.01)

(58) Field of Classification Search
CPC ..... B65D 2519/00099; B65D 2519/00124; B65D 2519/00159; B65D 2519/00194; B65D 2519/00273; B65D 2519/00293; B65D 2519/00333; B65D 2519/00452; B65D 2519/00497; B65D 2519/00597; B65D 2519/00641; B65D 2519/00726; B65D 2519/00815; B65D 2519/0082
USPC ..... 206/320, 386, 597, 600
See application file for complete search history.

(56) References Cited

U.S. PATENT DOCUMENTS

| | | | | |
|---|---|---|---|---|
| 3,995,736 | A * | 12/1976 | Lawson | B65D 19/20 206/596 |
| 6,540,085 | B1 * | 4/2003 | Davies | B65D 19/44 206/597 |
| 6,554,133 | B1 * | 4/2003 | Kropf | B65D 81/113 206/320 |
| 7,128,209 | B2 * | 10/2006 | Bringard | B65D 19/20 206/386 |
| 7,896,159 | B2 * | 3/2011 | Goda | B65D 19/20 108/55.1 |

FOREIGN PATENT DOCUMENTS

| | | |
|---|---|---|
| JP | 2001-130537 | 5/2001 |
| JP | 2004-268979 | 9/2004 |
| JP | 2004-307022 | 11/2004 |
| JP | 2010-030641 | 2/2010 |

* cited by examiner

PACKAGING BODY

CROSS-REFERENCE TO RELATED APPLICATION

This patent application is based on and claims priority pursuant to 35 U.S.C. § 119(a) to Japanese Patent Application No. 2017-082712, filed on Apr. 19, 2017, in the Japan Patent Office, the entire disclosure of which is hereby incorporated by reference herein.

BACKGROUND

Technical Field

This disclosure relates to a packaging body.

Related Art

Packaging methods of various products are different from each other according to the external dimensions and weights of products. Among various products, image forming apparatuses such as copiers and printers having a relatively heavy weight (40 kg or above) are packed and conveyed in a packaged form of a half slotted container (HSC) #200, which is a packaging type defined by JIS Z1507 0200.

Regarding the packaged form of the half slotted container (HSC), when binding a pallet that functions as a base on which a product is loaded and an outer box that surrounds the product, there are two known methods, which are a method of fixing the pallet and the box with multiple resin joints and another method of fastening a pallet and the top surface of a box with a polypropylene band (PP band). In the packaged form of the half slotted container (HSC), when a plywood pallet is employed, it is general to take the method of fastening the pallet and the top surface of the box with a PP band.

For example, in order to disassemble a used box easily and efficiently and dispose of the disassembled box efficiently as a waste material for recycling without classification, a flat sheet is employed as the material of a pallet to assemble the flat sheet into a three-dimensional shape by folding and slotting the material and to assemble an outer case in a tube shape by gluing.

SUMMARY

At least one aspect of this disclosure provides a packaging body including a base, a box, and a binding body. The base is a member on which a packaging target is placed. The box has a rectangular shape and an upper opening portion and is configured to cover a top face and side faces of the packaging target. The box includes first flaps and second flaps. The first flaps are disposed in pairs opposing to each other extending from opposite scorelines of the upper opening portion and including an opening through which an included object is inserted. The second flaps are disposed in pairs opposing to each other extending from different opposite scorelines of the upper opening portion and configured to be folded over the first flaps when the first flaps are folded. The binding body is configured to bind the base and the box and disposed between the first flaps and the second flaps.

Further, at least one aspect of this disclosure provides a packaging body including a base, a box, and a binding body. The base is a member on which a packaging target is placed. The box has a rectangular shape and an upper opening portion and is configured to cover a top face and side faces of the packaging target. The box includes first flaps and second flaps. The first flaps are disposed in pairs opposing to each other extending from opposite scorelines of the upper opening portion and including an opening through which an included object is inserted. The first flaps include partial flap portions defined by two slits extending in a direction perpendicular to a direction of the opposite scorelines of the first flaps of the upper opening portion. The second flaps are disposed in pairs opposing to each other extending from different opposite scorelines of the upper opening portion and configured to be folded over the first flaps when the first flaps are folded. The binding body is configured to bind the base and the box and disposed between the first flaps and the second flaps without overlaying the partial flap portions.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
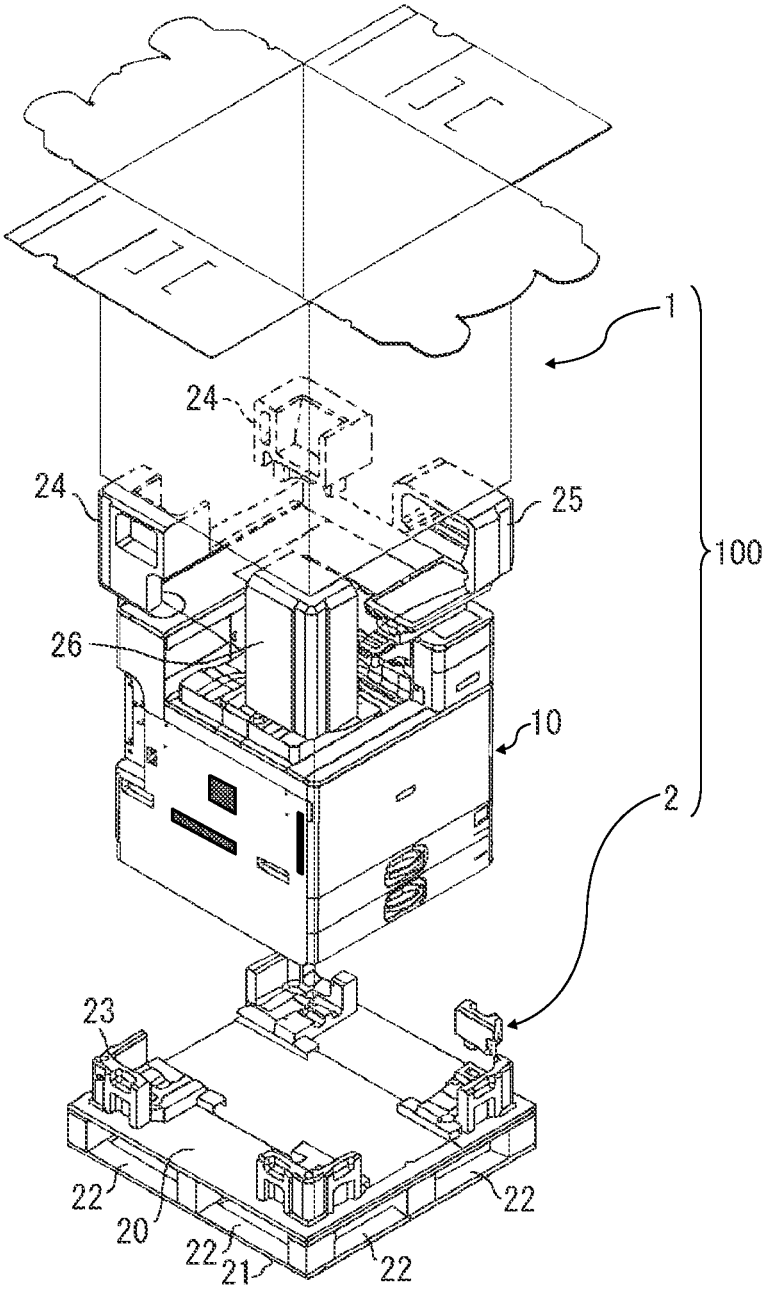
FIG. 1 is an exploded perspective view illustrating a configuration of a packaging body according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an embodiment applicable to a packaging body, with reference to the following figures.

FIG. 1 is an exploded perspective view illustrating a configuration of a packaging body 100 according to an embodiment of this disclosure. As illustrated in FIG. 1, the packaging body 100 includes an outer box 1 and a pallet 2. The outer box 1 covers and protects peripheral panels other than a bottom face, that is, a top surface and side faces of a product 10 (a packaging target). The product 10 may be an electronic device such as an image forming apparatus, as illustrated in FIG. 1, and other devices such as a device that performs digital processing on information and a device that performs analog processing electrically on video and sound. The pallet 2 functions as a base on which the packaging target is placed or loaded.

Figure 3:
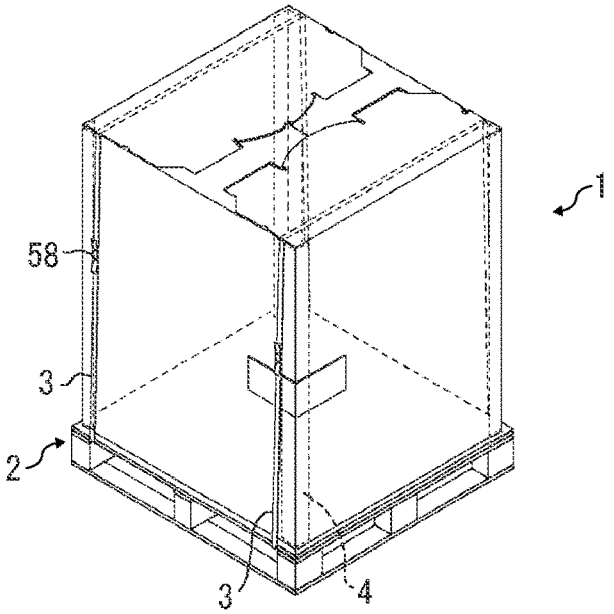
FIG. 3 is a perspective view illustrating the packaging body according to an embodiment of this disclosure.

As illustrated in FIG. 3, the outer box 1 and the pallet 2 are fixed with a binding member such as multiple bands 3 (two bands in the present embodiment) to prevent load shifting.

Figure 2:
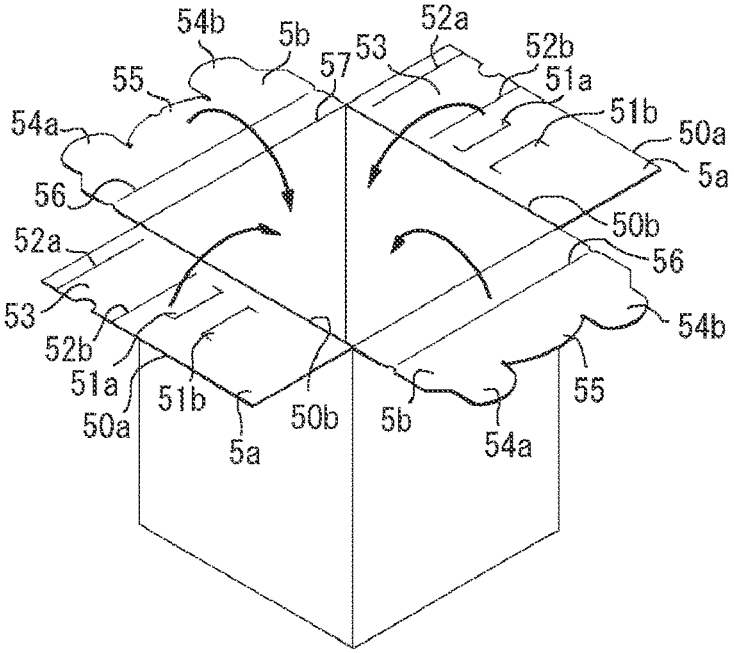
FIG. 2 is a perspective view illustrating how to close flaps of an outer box of the packaging body according to an embodiment of this disclosure.

The outer box 1 is assembled into a three-dimensional cylindrical shape having open top and bottom with no flaps. Specifically, as illustrated in FIGS. 2 and 3, a paper material (or a plastic included paper material) such as cardboard sheet is made into a cylindrical shape by sequentially folding the paper material inward by substantially 90 degrees, and then is bound by stapling one side edge to the other side edge at one corner end. Instead of gluing, the paper material may be bound by gluing.

Paper reinforcing members 4 having an L-shape in cross section, for example, are disposed at four side corners of the outer box 1, to reinforce each corner from inside. Further, the outer box 1 includes respective flaps integrally formed extending from corresponding scores of an upper opening portion having a three-dimensional cylindrical shape.

A detailed description of the flaps is given as follows.

The outer box 1 includes two first flaps (inner flaps) 5*a* formed in pairs and disposed opposing to each other, contiguous to and extending from respective opposite scorelines of the upper opening portion. By folding the first flaps 5*a* to cause respective leading edges 50*a* to meet in the center, a rectangular parallelepiped box is assembled with the upper opening portion being closed while a lower opening portion remains open.

Further, the first flaps 5*a* have respective slots 51*a* and 51*b* (two slots for each of the first flaps 5*a* in the present embodiment), so that the leading edges of the other flaps (outer flaps) can be inserted into the respective slots 51*a* and 51*b*. In addition, two slits 52*a* and 52*b* are formed extending from leading edges 50*a* toward a portion close to flap scorelines 50*b*. The two slits 52*a* and 52*b* are provided between a scoreline (i.e., a portion identical to a line of the upper opening portion of the cylindrical shaped outer box 1) of another flap near the slots 51*a*. The slots 51*a* and 51*b* define partial flap portions 53.

In the present embodiment, leading edges 50*a* of the first flaps 5*a* are straight lines. However, some parts of each of the leading edges 50*a*, for example, leading edges corresponding to the slots 51*a* and the slots 51*b* of the first flaps 5*a* may be provided with convex portions and concave portions. When the flaps are bent and folded, leading edges 50*a* of the first flaps 5*a* may meet in the center while the convex portions are covered or inserted into the opposing concave portions.

By contrast, the outer box 1 includes two second flaps (outer flaps) 5*b* formed in pairs and disposed opposing to each other, contiguous to and extending from the respective opposite scorelines of the upper opening portion having a cylindrical shape. The second flaps 5*b* includes two tuck portions 54*a* and 54*b* at respective leading edges and center protruding circle portions 55 arranged between the tuck portions 54*a* and 54*b*. The tuck portions 54*a* and 54*b* of each of the second flaps 5*b* are inserted into the slots 51*a* and 51*b* formed in the first flaps 5*a*. In order to make the inserting operation easily, the second flaps 5*b* have respective folding lines 56 running in parallel to the respective scorelines. The center protruding circle portions 55 of the second flaps 5*b* covers the meeting point of the first flaps 5*a* that close the upper opening portion of the outer box 1, to prevent the meeting point from shifting.

Referring to FIG. 1, the pallet 2 is a slatted board generally used for transportation and logistics. The pallet 2 is, for example, a plywood pallet having a predetermined vertical thickness to vertically have a loading face 20 on which a product is placed and an installation face 21 that is placed on a floor surface. Fork insertion openings 22 are provided between the loading face 20 and the installation face 21 in a direction of the thickness of the pallet 2, which is the vertical direction. As the prongs of the fork of a forklift are inserted into the fork insertion openings 22, the pallet 2 is supported by the forklift, so that a container or a packaging body can be moved.

Now, a description is given of how to package a product using such packaging body.

The product 10 is loaded on the pallet 2 at an appropriate position. At this time, lower cushioning materials 23 made by Styrofoam are provided on the loading face 20 of the pallet 2, at positions corresponding to the lower four corners of the product 10. By so doing, the bottom face of the product 10 is supported to protect the product 10 from impact applied from outside during shipping. In order to place the lower cushioning materials 23 at correct positions, any sheets having notches indicating the installation position of the product 10 may be attached on the pallet 2.

Next, the outer box 1 is placed on the pallet 2 such that the product 10 and the lower cushioning materials 23 are covered. Then, two first upper cushioning materials 24, a second upper cushioning material 25 and a third upper cushioning material 26, each of which also functions as a holding member, are placed on the product 10 that functions as a packaging target. By so doing, the top surface of the outer box 1 can be supported from below. Then, two first upper cushioning materials 24, a second upper cushioning material 25 and a third upper cushioning material 26, each of which also functions as a holding member, are placed on the product 10 that functions as a packaging target. By so doing, the top surface of the outer box 1 can be supported from below. A cover such as plastic bag may be provided over the product 10 to cover the panels of the product 10 other than the bottom face (or the entire panels of the product 10 including the bottom face) before the first upper cushioning materials 24, the second upper cushioning material 25 and the third upper cushioning material 26 are placed on the product 10.

Thereafter, the first flaps 5*a* of the outer box 1 placed on the pallet 2 are closed such that the respective leading edges 50*a* of the first flaps 5*a* meet in the center. After the first flaps 5*a* that function as a top surface of the outer box 1 are closed, two of the polypropylene bands 3, for example, used for packaging and banding are stretched on the first flaps 5*a* of the outer box 1. The bands 3 are stretched in a direction perpendicular to leading edges 50*a* of the first flaps 5*a*. Specifically, one of the two bands 3 is wound between the slits 52*a* and the flap scoreline 57, of the two slits 52*a* and 52*b* formed in the first flaps 5*a*, at a position relatively near the flap scoreline 57 of one of the second flaps 5*b*. Further, the bands 3 are wound through the fork insertion openings 22 of the pallet 2. By fastening respective couplings 58 having a name "speed stopper", the outer box 1 is fastened onto the pallet 2. At this time, since the strength is applied to the entire part of the outer box 1 by the holding members, i.e., the first upper cushioning materials 24, the second upper cushioning material 25 and the third upper cushioning material 26, the outer box 1 is prevented from being deformed when the outer box 1 is fixed by the bands 3.

After being fastened by the bands 3, the second flaps 5*b* are folded to overlay on the first flaps 5*a*. At this time, the folding lines 56 of the second flaps 5*b* are bent outwardly to form a convex portion or a mountain shape, and then the tuck portions 54*a* and 54*b* of each of the second flaps 5*b* are inserted into the slots 51*a* and 51*b* of the first flaps 5*a*. Thus, the packaging of the product 10 is completed, as illustrated in FIG. 3.

Now, a description is given of how to insert an additional item that is a container box including consumable supplies such as toner bottles and ink containers after completion of the packaging of a product. It is to be noted that the additional item is not limited to the above-described container box but also includes a display panel, a replacement part, a consumable part and a document such as a user's manual.

However, with such configurations including the above-described configuration in which a binding member such as a PP band is used to fasten the pallet and the top surface of the outer box, if an additional item is contained from the top surface side after the outer box is fixed with the binding member, the binding member is loosened or removed to put the additional item in the outer box and is fastened again, which is an extra operation.

There is another configuration in which the outer box has a side panel on which a window frame with perforations is provided so that additional items can be inserted therefrom. However, there is a case in which the compressive strength of the outer box is likely to deteriorate depending on the size and position of the window frame. In packaging an image forming apparatus, even after the product is shipped from factory in a full packaging state, there may be many cases that an additional item corresponding to a target country is inserted into the outer box at each site. However, a machining of a dedicated hole through which such additional item is inserted into the outer box has not been performed due to a reduction in compressive strength of the outer box. For these reasons, a great load is applied to an operator or operators each time at the additional packaging, which is a reduction in operability.

Figure 4:
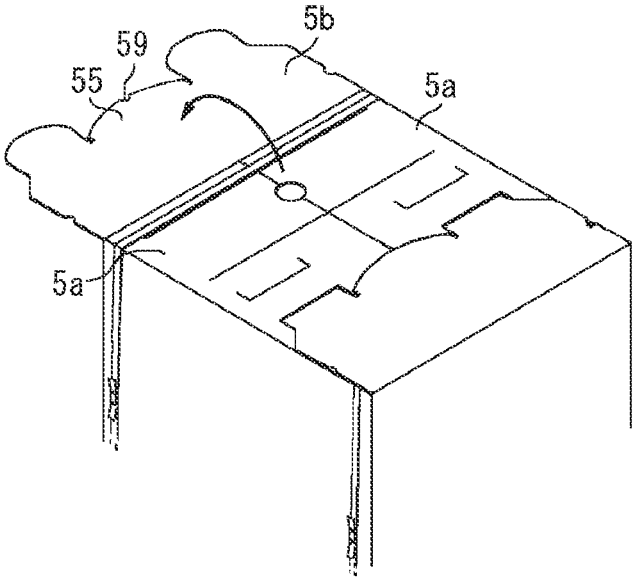
FIG. 4 is a diagram illustrating the packaging body in a state before partial flap portions are pulled to open so as to place an item to be included in the packaging body.
Figure 5:
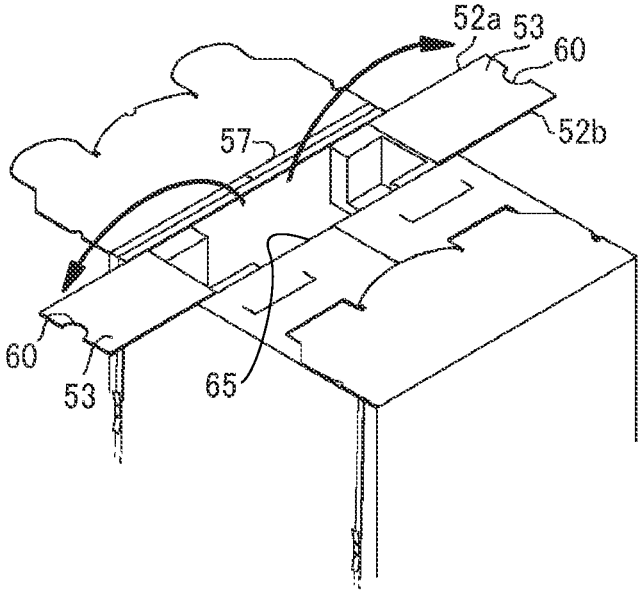
FIG. 5 is a diagram illustrating the packaging body in a state that the partial flap portions are opened to place the item to be included in the packaging body.

In order to address this inconvenience, first, one of the second flaps 5*b* that cover the first flaps 5*a* is opened, as illustrated in FIG. 4. In order to previously recognize the corresponding second flap 5*b* that covers an opening 65 in which the additional item is to be included, the corresponding second flap 5*b* may have a cut portion 59 as a mark in the center protruding circle portion 55. Instead of the cut portion 59, the mark may be another marking object or a seal. Then, by opening the partial flap portions 53 defined by the slits 52*a* and 52*b* of the first flaps 5*a*, the opening 65 of the first flaps 5*a* comes to appear. In order to easily open the partial flap portions 53, cut hole portions 60 are formed at the respective leading ends of the partial flap portions 53. By inserting the finger of a user into a hole formed by the cut hole portions 60 and pulling the partial flap portions 53, the partial flap portions 53 can be opened to the left and right sides, as illustrated in FIG. 5. Instead of the partial flap portions 53, an opening may be formed by removing the partial flap portions 53, that is, with no partial flap portions 53. The dimensions of the opening 65 is determined according to an additional item to be included in the outer box 1.

Of the slits 52*a* and 52*b* formed in the first flaps 5*a*, the band 3 is wound around between the flap scoreline 57 and the slit 52*a* near the flap scoreline 57 of one of the second flaps 5*b*. Therefore, the band 3 is wound without overlaying the partial flap portions 53. Accordingly, the partial flap portions 53 can be pulled to open without removing the band 3 and releasing the fixed condition of the outer box 1 and the pallet 2. Further, even when the band 3 is shifted, the band 3 is caught by the flap scoreline 57 of the second flap 5*b*. Therefore, the band 3 can be prevented from shifting during insertion of an additional item into the outer box 1.

Of the slits 52*a* and 52*b* formed in the first flaps 5*a*, the band 3 is wound around between the flap scoreline 57 and the slit 52*a* near the flap scoreline 57 of one of the second flaps 5*b*. Therefore, the band 3 is wound without overlaying the partial flap portions 53. Accordingly, the partial flap portions 53 can be pulled to open without removing the band 3 and releasing the fixed condition of the outer box 1 and the pallet 2. Further, even when the band 3 is shifted, the band 3 is caught by the flap scoreline 57 of the second flap 5*b*. Therefore, the band 3 can be prevented from shifting during insertion of an additional item into the outer box 1.

In a case in which an opening is formed by cutting and removing part of the flaps, the partial flap portions are not pulled to open. Therefore, the band 3 may be would over the opening as long as the additional item can be inserted into or removed from the outer box 1. Further, by providing the opening to the first flaps 5*a* alone, without the second flaps 5*b*, a reduction in compressive strength of the packaging body can be restrained, and therefore the lower part of the packaging body does not expand outwardly when the packaging body is loaded.

Figure 6:
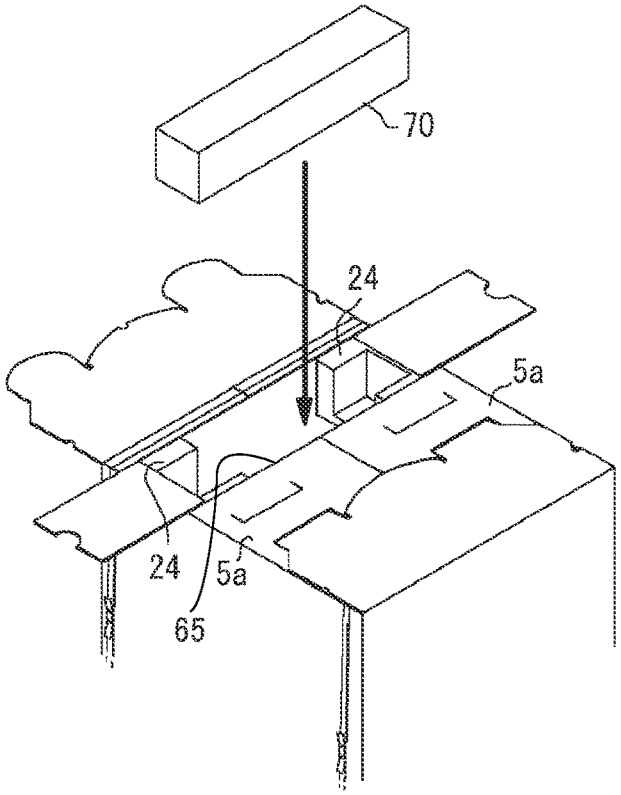
FIG. 6 is a diagram illustrating the packaging body in a state immediately before the item is put to be placed in the packaging body.
Figure 7:
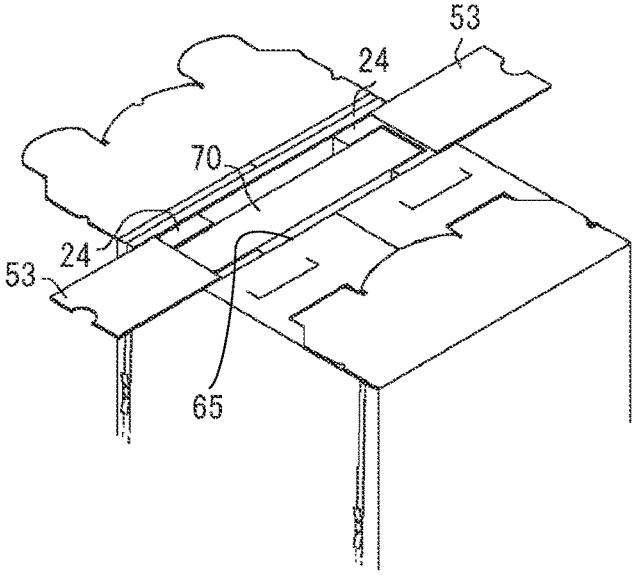
FIG. 7 is a diagram illustrating the packaging body in a state immediately before the item is put to be placed in the packaging body.
Figure 8:
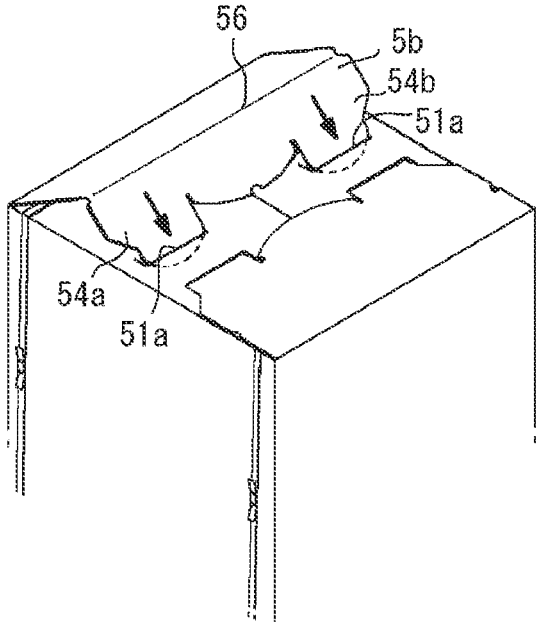
FIG. 8 is a diagram illustrating the packaging body in a state that first flap portions are inserted into respective slots after the item is placed in the packaging body.
Figure 9:
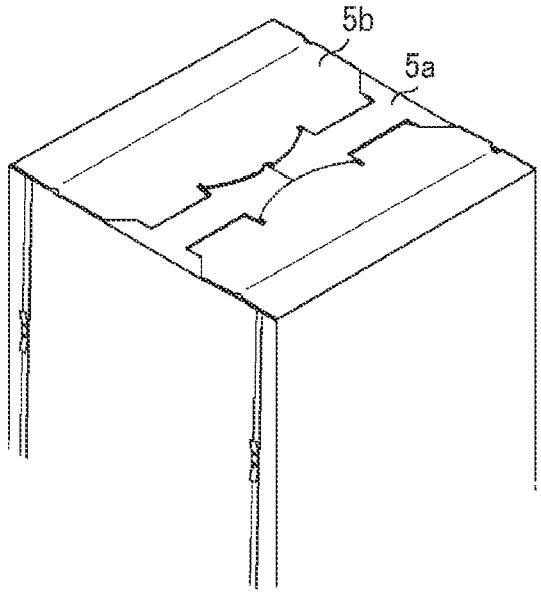
FIG. 9 is a diagram illustrating at completion of placing the item in the packaging body.

An item 70 is placed between the first upper cushioning materials 24 through the opening 65 of the first flaps 5*a*, so that the item 70 is held by the first upper cushioning materials 24, as illustrated in FIGS. 6 and 7. By so doing, the item 70 is held in the opening 65 by the first upper cushioning materials 24 that function as a holding member placed on the product 10. Accordingly, the item 70 is held in the opening and contained stably. After holding the item 70, the partial flap portions 53 are closed. While the folding line 56 of the second flap 5*b* that is opened is being folded to form a convex portion, the respective tuck portions 54*a* and 54*b* of the opening second flap 5*b* are inserted into the slots 51*a* of the first flaps 5*a*, as illustrated in FIG. 8. Then, the second flap 5*b* is overlaid on the first flaps 5*a* to complete the insertion of the item 70, as illustrated in FIG. 9.

With the above-described configurations, even after completion of packaging a product that functions as a packaging target, an item can be added in the packaging body. Specifically, in packaging an image forming apparatus, when a production site of the apparatus body and a production site of consumable supplies are different, such consumable supplies (such as ink and toner) susceptible to environment are shipped separate from the apparatus body of the image forming apparatus. Therefore, such consumable supplies may be included as additional items after the image forming apparatus has been shipped. According to the configurations of this disclosure, items that are different from an image forming apparatus in production site and shipping route can be additionally included in the packaging body.

It is to be noted that this disclosure is applicable not only to the packaged form of half slotted container (HSC) but also to a packaged form of regular slotted container (RSC) with the closed bottom face. Since the container that is an outer box is loaded on a pallet that functions as a base and the container and the pallet are bound by a binding member, the packaging target can be loaded on the pallet via the bottom face of the packaging target. It is to be noted that there may be a case that no pallet is used. In this case, the band is wound and bound between the bottom face and side panels of the container and the first flaps and the second flaps. Therefore, the bottom face of the container functions as a base.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A packaging body comprising:

a base on which a packaging target is placed;

a box having a rectangular shape and an upper opening portion and configured to cover a top face and side faces of the packaging target, the box including:

first flaps disposed in pairs opposing to each other extending from opposite scorelines of the upper opening portion and including respective leading edges, the first flaps configured to fold down to a closed position in which the leading edges converge to close the upper opening portion of the box, the first flaps including respective partial flap portions disposed in pairs opposing to each other extending from opposite ones of the leading edges and configured to fold up to an opened position to create a partial opening in the upper opening portion while a remainder of the first flaps remain in the closed position, the partial opening sized to fit an included object; and second flaps disposed in pairs opposing to each other extending from different opposite scorelines of the upper opening portion and configured to be folded over the first flaps when the first flaps are folded to the closed position; and a binding body configured to bind the base and the box and disposed between the first flaps and the second flaps.

2. The packaging body according to claim 1, wherein the binding body is bound without overlapping the partial opening.

3. The packaging body according to claim 1, further comprising a cushioning body disposed at a corner inside the box and placed on the included object, wherein part of the cushioning body holds the included object placed in the partial opening.

4. The packaging body according to claim 3, further comprising:

multiple binding bodies, wherein at least one of the multiple binding bodies is disposed at a position corresponding to the cushioning body.

5. The packaging body according to claim 1, wherein the base includes a pallet.

6. The packaging body according to claim 1, wherein one of the second flaps is configured to cover the partial opening and includes a mark to indicate which of the second flaps to open to expose the partial flap portions for opening the partial opening.

7. The packaging body according to claim 1,
wherein the first flaps have respective slots, and
wherein the second flaps have respective tuck portions configured to be inserted into the respective slots.

8. The packaging body according to claim 1,
wherein the packaging target is an image forming apparatus and the included object is a container box.

9. The packaging body according to claim 1,
wherein the packaging target is an electronic device and the included object is at least one of a display panel, a replacement part, a consumable part, and a document.

10. The packaging body according to claim 1,
wherein the leading edges of the partial flap portions include indentations to collectively form a grip hole when the partial flap portions are in the closed position.

11. The packaging body according to claim 1,
wherein the leading edges of the partial flap portions meet at a center of the upper opening portion when the partial flap portions are in the closed position.

12. The packaging body according to claim 1,
wherein the partial flap portions collectively form the partial opening when both of the partial flap portions are folded up to the opened position.

13. A packaging body comprising:
a base on which a packaging target is placed;
a box having a rectangular shape and an upper opening portion and configured to cover a top face and side faces of the packaging target,
the box including:
first flaps disposed in pairs opposing to each other extending from opposite scorelines of the upper opening portion and including respective leading edges, the first flaps configured to fold down to a closed position in which the leading edges converge to close the upper opening portion of the box,
the first flaps including partial flap portions disposed in pairs opposing to each other and defined by two slits in each of the first flaps that extend from the leading edges in a direction perpendicular to a direction of the opposite scorelines of the first flaps of the upper opening portion, the partial flap portions configured to fold up to an opened position to create a partial opening in the upper opening portion while a remainder of the first flaps remain in the closed position, the partial opening sized to fit an included object; and
second flaps disposed in pairs opposing to each other extending from different opposite scorelines of the upper opening portion and configured to be folded over the first flaps when the first flaps are folded to the closed position; and
a binding body configured to bind the base and the box and disposed between the first flaps and the second flaps without overlaying the partial flap portions.

14. The packaging body according to claim 13, further comprising a cushioning body disposed at a corner inside the box and placed on the included object,
wherein part of the cushioning body holds the included object placed in the partial opening.

15. The packaging body according to claim 14, further comprising:
multiple binding bodies,
wherein at least one of the multiple binding bodies is disposed at a position corresponding to the cushioning body.

16. The packaging body according to claim 13,
wherein the base includes a pallet.

17. The packaging body according to claim 13,
wherein one of the second flaps is configured to cover the partial opening and includes a mark to indicate which of the second flaps to open to expose the partial flap portions for opening the partial opening.

18. The packaging body according to claim 13,
wherein the first flaps have respective slots, and
wherein the second flaps have respective tuck portions configured to be inserted into the respective slots.

19. The packaging body according to claim 13,
wherein the packaging target is an image forming apparatus and the included object is a container box.

20. The packaging body according to claim 13,
wherein the packaging target is an electronic device and the included object is at least one of a display panel, a replacement part, a consumable part, and a document.

* * * * *